US005201645A

United States Patent [19]

Steele

[11] Patent Number: 5,201,645

[45] Date of Patent: Apr. 13, 1993

[54] COMPLIANT DEVICE FOR A SCROLL-TYPE COMPRESSOR

[75] Inventor: Duane F. Steele, Onsted, Mich.

[73] Assignee: Ford Motor Company, Dearborn, Mich.

[21] Appl. No.: 916,355

[22] Filed: Jul. 20, 1992

[51] Int. Cl.[5] ..... F04C 18/04

[52] U.S. Cl. ..... 418/14; 418/55.5; 418/57

[58] Field of Search ..... 418/14, 55.5, 57

[56] References Cited

U.S. PATENT DOCUMENTS

| | | | |
|---|---|---|---|
| 4,580,956 | 4/1986 | Takahashi et al. | 418/14 |
| 4,731,000 | 3/1988 | Haag | 418/55.3 |
| 5,165,879 | 11/1992 | Kondo et al. | 418/55.5 |

FOREIGN PATENT DOCUMENTS

| | | |
|---|---|---|
| 0270917 | 6/1988 | European Pat. Off. . |
| 3619338 | 12/1986 | Fed. Rep. of Germany . |
| 58-131387 | 8/1983 | Japan . |
| 61-8405 | 1/1986 | Japan . |
| 62-78492 | 4/1987 | Japan . |

OTHER PUBLICATIONS

E. L. Wilfert, Japanese and American Competition in the Development of Scroll Compressors and Its Impact on the American Air Conditioning Industry, Feb. 1990, Pertinent p. 3.5.

*Primary Examiner*—John J. Vrablik

*Attorney, Agent, or Firm*—Roger L. May; Charles H. Ellerbrock

[57] ABSTRACT

A compliant device for a scroll-type fluid compressor including a drive shaft having an axis of rotation. A disk shaped rotor is affixed at one end of the drive shaft and includes a drive pin extending from the side of the rotor opposite the drive shaft. The drive pin 13 disposed at a location eccentric to the axis of rotation of the drive shaft and includes at least one external spline extending therefrom. The scroll-type fluid compressor includes a bushing having an axis of revolution and an orbiting fluid displacement member which is movable in cooperating relationship with the bushing. The bushing has an aperture adapted to receive the drive pin including at least one internal spline mating with the external spline of the drive pin. Clearances defined between the external spline and the internal spline allow displacement of the disk shaped rotor in relation to the bushing upon rotation of the drive shaft. This displacement allows the line contacts occurring between the orbiting scroll and the affixed scroll of the scroll-type fluid compressor to separate, thereby allowing the scroll-type fluid compressor to start up in an unloaded condition.

9 Claims, 1 Drawing Sheet

COMPLIANT DEVICE FOR A SCROLL-TYPE COMPRESSOR

TECHNICAL FIELD

The present invention relates to scroll-type fluid compressors, and in particular to a scroll-type fluid compressor compliant device.

BACKGROUND ART

Scroll-type fluid compressors are well known in the prior art. U.S. Pat. No. 4,432,708 issued to Hiraga et al discloses an apparatus including two scrolls, each having a circular end plate and a spiral element disposed on each plate. The scrolls are equally offset such that both spiral elements cooperate to make a plurality of line contacts between their spiral curved surfaces.

In operation, one of the scrolls is subjected to an orbital motion and the line contacts shift, resulting in a change in the volume of the fluid pockets contained within the scrolls. This change in volume of the fluid pockets is utilized to compress fluids, for example, air conditioning refrigerants needed for operation of air conditioning systems in automobiles.

Compliant devices of various construction have been designed into scroll-type compressors of the prior art. Scroll-type compressors intended for automotive use include compliant devices to overcome disadvantages associated with compressor operation in general. It is known in the art that an air conditioning compressor generally requires the greatest driving power during start-up. Thus, if the compressor is connected to a driving power source, for example, an internal combustion engine of an automobile, a significant load is imposed on the engine during compressor start-up. Compliant devices are utilized to reduce start-up torque requirements supplied by the compressor driving power source to the compressor.

In addition, a condition called "slugging" is detrimental to the internal components of scroll-type air conditioning compressors. Slugging occurs when fluid refrigerant used in the air conditioning system condenses into a liquid. This condition exists when the automobile is subjected to cold temperatures during the winter months and during large temperature deviations such as in day/night cycles in desert areas. The refrigerant in the gaseous state tends to migrate into the lower temperature areas of the internal components of the compressor. Specifically, the refrigerant in the gaseous state condenses in the cavities formed within the two interfitting scrolls.

Operation with the refrigerant in a condensed or liquid state is detrimental to the internal components of the air conditioning compressor because the compressor is designed to compress only fluids in a gaseous form, not fluids in liquid form. Attempted compression of liquid refrigerants may stress or deform various internal compressor components and sometimes disables the compressor entirely.

U.S. Pat. No. 4,580,956 to Takahashi et al. discloses a scroll-type fluid compressor including a compliant device. The apparatus comprises a housing, a fixed fluid displacement member and an orbiting fluid displacement member. Upon startup, a spring pushes an orbiting fluid displacement member in a direction which reduces its orbital radius. Thus, the spring acts as a compliant, or restriction device which operates to separate the line contacts between a fixed member and the orbiting member until the orbiting member reaches a predetermined rotational frequency.

The predetermined rotational frequency is set such that the compressor starts in an unloaded condition and eventually progresses to a fully operational condition. The compliant device in the Takahashi patent displaces the revolutional axis of the support bushing, thereby displacing the revolutional axis of the orbiting scroll. This displacement separates the line contacts between the orbiting and fixed scrolls and hinders compression during start-up within the apparatus. However, the Takahashi compliant device is expensive to manufacture and assemble in mass production. In addition, it includes various mechanical components that will over time fail.

European Patent No. 270917 discloses another compliant device comprised of a disc shaped rotor with an aperture eccentric to the outer casing of the rotor for accommodating a shaft. A rubber substance is used to fill the intervening space between the aperture and the casing for absorbing various forces applied upon the aperture during rotation of the disc rotor.

SUMMARY OF THE INVENTION

A compliant device for a scroll-type fluid compressor according to the present invention includes a drive shaft having an axis of rotation and a disc-shaped rotor affixed to the drive shaft. The disc-shaped rotor has a drive pin extending from the side of the rotor opposite the drive shaft, at a location eccentric to the axis of rotation. The drive pin includes at least one external spline extending from the drive pin. A bushing supports an orbiting scroll member which is movable in cooperation with the bushing. The bushing has an aperture adapted to receive the drive pin, including at least one internal spline which mates with the extending external spline located on the drive pin. The external and internal splines define a clearance between their surfaces to allow arcuate displacement between the disc-shaped rotor in relation to the bushing upon rotation of the drive shaft.

An alternative embodiment of the present invention includes a drive pin having a plurality of external and corresponding internal splines. In this embodiment, multiple clearances are defined between the radial and circumferential surfaces of the internal and external splines. The clearances are utilized to allow a displacement of the disc-shaped rotor in relation to the bushing. This displacement alters the relationship of the axis of rotation of the disc-shaped rotor in relation to the axis of revolution of the bushing.

In each embodiment, because the bushing supports the orbiting scroll member, this displacement creates a separation of the line contacts between the orbiting scroll and a fixed scroll which the orbiting scroll interfits with. The separation of line contacts allows the scroll-type fluid compressor to start-up in an unloaded condition.

The primary object of the present invention is to provide a scroll-type fluid compressor including a compliant device for allowing start-up of a scroll-type fluid compressor in an unloaded condition.

It is another object of the present invention to provide a scroll-type fluid compressor including a compliant device capable of reducing start-up torque required from an internal combustion engine used to drive the displacement apparatus.

It is still another object of the present invention to provide a scroll-type fluid compressor including a compliant device which represents a precision compliant mechanism which is easy to fabricate and assemble in mass production manufacturing operations.

It is still yet another object of the present invention to provide a scroll-type fluid compressor including a compliant device capable of reducing slugging pressures created by operation with a liquid refrigerant during cold weather conditions.

It is a further object of the invention to provide a scroll-type fluid compressor including a compliant device which compensates for various machining tolerances and normal operating wear of the internal components of the scroll-type fluid compressor during normal operation.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figures 1, 2, 3:
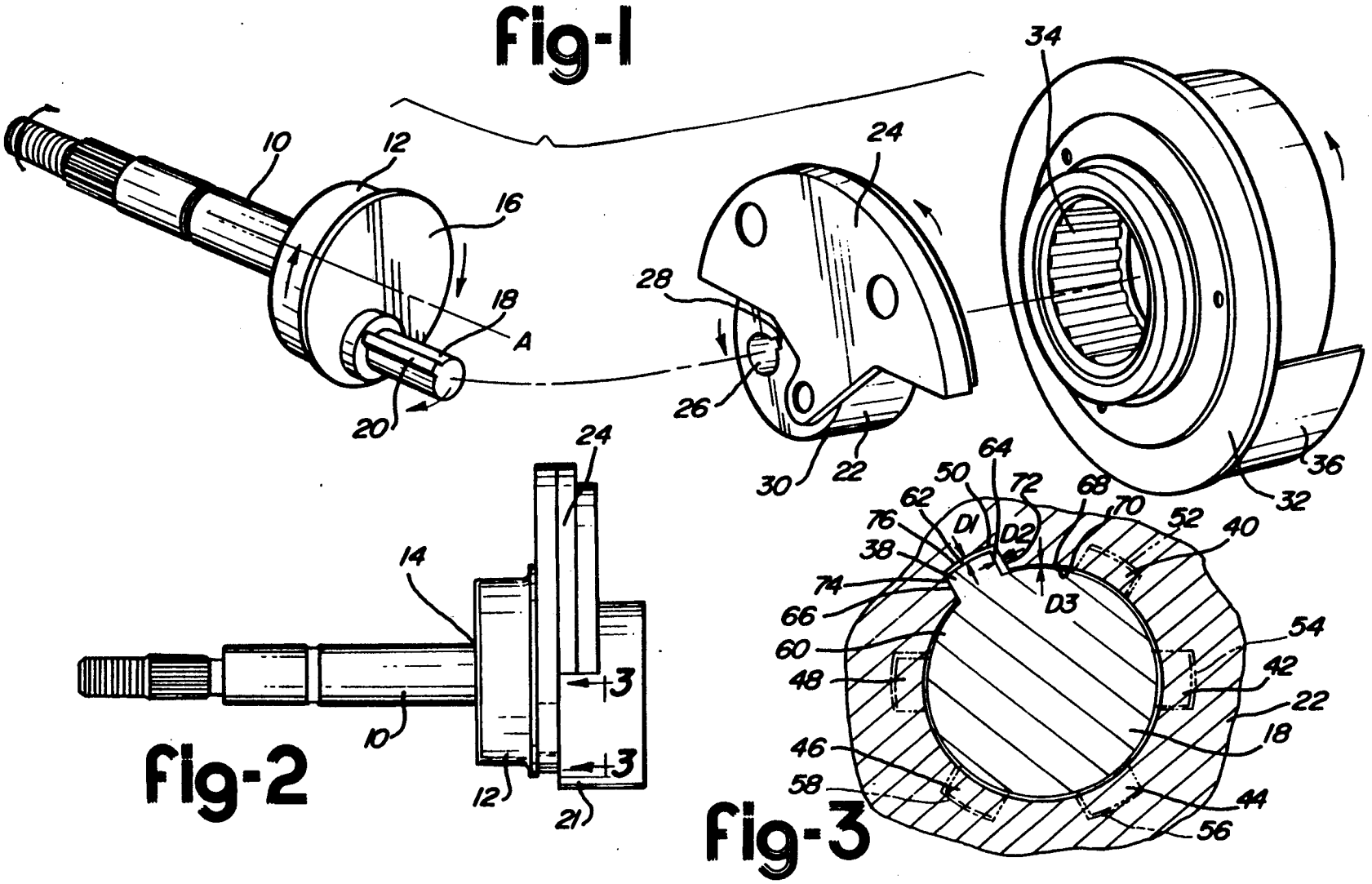
FIG. 1 is a exploded perspective view of a main drive shaft, drive pin, support bushing, and orbiting scroll member of the present invention.
FIG. 2 is a side elevational view of an alternative embodiment of the present invention, showing the main drive shaft and bushing wherein the drive pin includes a plurality of radially extending splines and the bushing includes a plurality of corresponding internal splines.
FIG. 3 is a cross-sectional view of the drive pin and bushing of the present invention taken along line 3—3 of FIG. 2.

Referring first to FIG. 1, in accordance with one embodiment of the present invention, there is shown a drive shaft 10 for a scroll-type fluid compressor. Drive shaft 10 includes a disc-shaped rotor 12 affixed at end 14 of the drive shaft, as also shown in FIG. 2. Disc-shaped rotor 12 has a planar surface 16 with a drive pin 18 extending from a portion of the planar surface.

Main drive shaft 10 has an axis of rotation "A", as shown in FIG. 1. Drive pin 18 is located on disc-shaped rotor 12 so that it lies eccentric to axis of rotation "A". An external spline 20 extends radially from drive pin 18. A bushing 22 is provided with a counterweight 24 affixed to the bushing.

Bushing 22 has an aperture 26 configured to accept drive pin 18. Aperture 26 includes a mating internal spline 28 for receiving external spline 20. Bushing 22 includes a bearing surface 30. Orbiting scroll 32 has a centrally disposed bearing means 34 configured to accept the bushing surface 30 of bushing 22. Orbiting scroll 32 has a spiral wrap 36 affixed on the scroll opposite bearing means 34.

FIGS. 2 and 3 show a preferred embodiment of the present invention wherein drive shaft 10 is coupled with bushing 22. Drive pin 18 is received within aperture 26. In this preferred embodiment of the present invention, drive pin 18 includes a plurality of external splines to provide a relatively uniform distribution of circumferential start-up torque around drive pin 18. As shown in FIG. 3, external splines 38, 40, 42, 44, 46, and 48 all extend from drive pin 18. Bushing 22 includes a plurality of corresponding internal splines 50, 52, 54, 56, 58 and 60, which mate with external splines 38, 40, 42, 44, 46, 48, respectively.

External spline 38 is representative of each external spline referenced above and includes a top wall 62, a first side wall 64 and a second side wall 66. Drive pin 18 further includes base surface 60 located on the circumference of the drive pin disposed between adjacent extending external splines.

Aperture 26 of bushing 22 includes a basal surface 70 corresponding to base surface 68. Aperture 26 further includes a first lateral surface 72 corresponding to first side wall 64, a second lateral surface 74 corresponding to second side wall 66, and an inner receiving wall 76 corresponding to top wall 62.

A first clearance $D_1$ is defined by the distance between top wall surface 62 and inner receiving wall 76 and is shown in FIG. 3. First clearance $D_1$ is in a range of about 0.0005 to 0.002 inches with the preferred embodiment of the present invention utilizing a clearance distance $D_1$ of 0.001 inches. A second clearance $D_2$ is defined by the distance between first side wall 64 and first lateral surface 72 and is in a range of about 0.01 to 0.05 inches. The preferred embodiment of the present invention utilizes a second clearance $D_2$ of 0.02 inches. A third clearance $D_3$ is defined by the distance between base wall surface 68 and basal surface 70 and is also in a range of about 0.0005 to 0.002 inches. The preferred embodiment of the present invention utilizes a third clearance $D_3$ of about 0.001 inches.

In operating the scroll-type fluid compressor of the present invention, main drive shaft 10 is rotated about axis "A" through means of drive belt and clutch assembly (not shown) driven by the internal combustion engine of the automobile. As main drive shaft 10 is rotated, it induces a relative orbital motion in bushing 22. Bushing 22 supports orbiting scroll member 34, and the orbital motion of bushing 22 is transferred to orbiting scroll 34. Orbiting scroll 32 interfits with a fixed scroll (not shown) to create a plurality of line contacts defined by the cooperating connections of the spiral wraps included on both scrolls. In a steady state, as orbiting scroll 34 is orbited around an axis of revolution (not shown), the line contacts shift, creating fluid pockets that become progressively smaller.

The compliant device of the present invention utilizes a combination of the clearances $D_1$, $D_2$ and $D_3$ shown in FIG. 3, to temporarily offset the axis of revolution of the orbiting scroll 32. If the axis of revolution of the orbiting scroll 32 is offset or displaced slightly, the line contacts between the orbiting scroll 32 and the fixed scroll (not shown) become separated. This separation of the orbiting and fixed scrolls allows the fluid pockets to disperse the refrigerant without significantly compressing the refrigerant, thereby reducing loads otherwise sustained upon startup.

Referring now to FIG. 3, a combination of first clearance $D_1$ and a second clearance $D_2$ permits arcuate displacement of the bushing 22 in relation to the disc-shaped rotor 12, upon rotation of the drive shaft. It has been found that the combination of $D_1$, $D_2$ and $D_3$ produces a sufficient displacement to separate the line contacts between the orbiting scroll and the fixed scroll.

It is contemplated that the best mode for carrying out the present invention utilizes a plurality of corresponding internal and external splines as shown in FIG. 3. However, a drive pin including one external spline and a corresponding aperture including one mating internal spline would also effectuate displacement sufficient to absorb most start-up torque.

An increase in the rotational speed of the main drive shaft 10 and the attendant centrifugal forces generated by bushing 30 and orbiting scroll 32 eventually overcome the combination of clearances $D_1$, $D_2$ and $D_3$. The main drive shaft 10, disc-shaped rotor 12, bushing 30 and orbiting scroll member 34 combination are cooperatively designed such that the requisite line contacts needed for adequate scroll compressor operation are achieved upon reaching a continuous predetermined centrifugal force or rotational speed of the main drive shaft.

Thus, at the initial driving phase of the compressor, the scroll-type fluid compressor is started in an unloaded condition. As the line contacts of the orbiting and fixed scrolls are separated, significant fluid compression does not take place and orbital motion of the orbiting scroll is afforded with less and initial impulsive forces.

As stated previously, a scroll-type fluid compressor expends or requires the greatest amount of energy in the initial driving phase. If the scroll-type fluid compressor is started up in the unloaded condition, a reduction in horsepower required by the internal combustion engine to be transferred to the main drive shaft is achieved. This reduction in horsepower utilization in the internal combustion engine reduces engine slow down when the compressor is engaged. This reduction translates into a less noticeable clutch engagement in operation.

In addition, the detrimental effects of a "slugging" condition are minimized by use of the compliant device of the present invention. If the scroll-type fluid compressor is energized while a fluid refrigerant is in a liquid state and thus has previously migrated to cooler fluid pockets defined by the line contacts of the interfitting scrolls, damage can be sustained to various components within the scroll-type fluid compressor. The compliant device of the present invention allows for accommodation or a slight displacement of the axis of revolution of the orbiting scroll during initial start-up of the scroll-type fluid compressor.

The displacement of the axis of revolution of the orbiting scroll allows a predetermined arcuate displacement of the bushing in relation to the disc-shaped rotor to occur. Compliance between the orbiting fluid displacement member and the fixed fluid displacement member allows the orbiting fluid displacement member to orbit for a short period of time in the initial start-up phase without compression occurring. This compliant period allows the refrigerant in its liquid state to return to the gaseous state prior to severe internal damage of the interfitting orbiting scroll and the fixed scroll.

In addition to a reduction in horsepower needed to initially start-up the scroll-type fluid compressor of the present invention and a reduction in slugging conditions, the present invention also allows for machining tolerances and normal wear conditions. As shown in FIG. 1, a counterweight 24 is affixed to bushing 30 to reduce various vibrational forces created by the orbiting motion of bushing 22.

The compliant device design of the present invention utilizes few additional mechanical components. This absence of mechanical components increases the overall life of the compliant device. In addition, in large manufacturing assembly conditions, the compliant device of the present invention is easy to produce because of the simplicity of the spline arrangement. A reduction in faulty scroll compressors leaving the manufacturing stage of automobile production is thus reduced and the associated down time associated with repair procedures is alleviated.

This invention has been described in detail in connection with the preferred embodiments, but these are examples only and the invention is not restricted thereto. It will be easily understood by those skilled in the art that other variations and modifications can be easily made within the scope of this invention.

I claim:

1. A scroll-type fluid compressor comprising:

a drive shaft having an axis of rotation;

a disc-shaped rotor affixed at one end of said drive shaft, said disc-shaped rotor including a drive pin extending from a side of said rotor opposite said drive shaft at a location eccentric to said axis of rotation said drive pin including at least one external spline extending therefrom;

a bushing having an axis of revolution;

an orbiting fluid displacement member which is movable in a cooperating relationship with said bushing;

said bushing having an aperture adapted to receive said drive pin, said aperture including at least one internal spline mating with said external spline, said at least one external and internal splines defining a clearance therebetween to allow displacement of said disc-shaped rotor in relation to said bushing upon rotation of said drive shaft.

2. A scroll-type fluid compressor as in claim 1 wherein:

said at least one external spline includes a top wall, a first side wall and second side wall extending therefrom, and a base surface; and said at least one internal spline includes a basal surface which lies in facing relationship to said base wall surface, a first lateral surface which lies in facing relationship to said first side wall, a second lateral surface which lies in facing relationship to said second side wall and an inner receiving wall lying in facing relationship to said top wall.

3. A scroll-type fluid compressor as in claim 2 wherein said top wall and inner receiving wall define a first clearance ($D_1$) therebetween and said first side wall and first lateral surface define a second clearance ($D_2$) therebetween.

4. A scroll-type fluid compressor as in claim 3 wherein said first clearance ($D_1$) is in a range of about 0.0005 to 0.002 inches.

5. A scroll-type fluid compressor as in claim 3 wherein said second clearance ($D_2$) is in a range of about 0.01 to 0.05 inches.

6. A scroll-type fluid compressor as in claim 2 wherein said base wall surface and basal surface define a third clearance ($D_3$) therebetween.

7. A scroll-type fluid compressor as in claim 6 wherein said third clearance is in a range of about 0.0005 to 0.002 inches.

8. A scroll-type fluid compressor having a fixed fluid displacement member interfitting with an orbiting fluid displacement member to form a plurality of line contacts defining at least one fluid pocket, said scroll-type fluid compressor comprising:

a drive shaft having an axis of rotation;

a disc-shaped rotor affixed at one end of said drive shaft, said disc-shaped rotor including a drive pin extending from a side of said rotor opposite said drive shaft at a location eccentric to said axis of rotation, said drive pin including at least one external spline extending therefrom;

a bushing supporting the orbiting fluid displacement member, said bushing having an aperture adapted to receive said drive pin, said aperture including at least one internal spline mating with said at least one external spline, said at least one external and internal splines defining a clearance therebetween to allow displacement of said disc-shaped rotor in relation to said bushing upon rotation of said drive shaft bushing such that said line contacts are partially separated.

9. A scroll-type fluid compressor as in claim 8 wherein said at least one external spline extends radially from said drive pin.

* * * * *